United States Patent [19]

Waiser

[11] 4,452,107

[45] Jun. 5, 1984

[54] RATCHET-TYPE REVERSIBLE WRENCH

[76] Inventor: Shimon Waiser, P.O. Box 360 Midwood Station, Brooklyn, N.Y. 11230

[21] Appl. No.: 331,667

[22] Filed: Dec. 17, 1981

[51] Int. Cl.[3] ..... B25B 13/46

[52] U.S. Cl. ..... 81/63.2

[58] Field of Search ..... 81/60, 63.1, 58.1, 63.2, 81/58.4, 58, 63

[56] References Cited

U.S. PATENT DOCUMENTS

| | | | |
|---|---|---|---|
| 766,577 | 8/1904 | Ansorge | 81/60 |
| 951,316 | 3/1910 | Heinrich et al. | 81/58.4 |
| 974,121 | 11/1910 | Case | 81/58.4 |
| 3,650,165 | 3/1972 | Wolfe | 81/58.1 |
| 4,254,675 | 3/1981 | Marlow et al. | 81/63 |

*Primary Examiner*—James L. Jones, Jr.

[57] ABSTRACT

A ratchet-type reversible wrench has an outer housing member rotatable relative to an inner member, and a handle connected with said housing member. A special ratchet mechanism provided in the wrench and including a tooth in outer housing member and a plurality of projections in the inner member for joint rotation of the members in one direction and disengagement of the members during rotation of the outer housing member in another direction. The inner member is provided with two square studs projecting outside of said inner member to connect with sockets. The handle performs a limited transverse counter motion relative to the outer housing member. This outer housing member is provided with a rod transferring effort from the switch of direction of rotation located on the handle to the ratchet mechanism.

7 Claims, 11 Drawing Figures

RATCHET-TYPE REVERSIBLE WRENCH

BACKGROUND OF THE INVENTION

This invention relates to a wrench that is widely used in connection with the usual conventional socket wrench elements by mechanics and servicemen in shops and garages for all types of mechanical apparatus for assembly or disassembly.

More specifically, this invention is directed to a reversible ratchet wrench having unlimited uses as a wrench unit and one which, for example, is well adapted to connect with and operate socket wrenches for working nuts and bolts and the like.

However, the known reversible ratchet-type wrench has the considerable disadvantage in that the ratchet mechanism of the wrench is inside the head of said wrench and so a switch of direction of rotation of a socket is on the wrench head. In hard accesible spots it is vey difficult and sometimes impossible to reach said switch. No attempts have been made to solve this problem.

SUMMARY OF THE INVENTION

Accordingly, it is an object of the present invention to provide a ratchet-type wrench which avoids the disadvantages of the prior art.

More particularly, it is an object of the present invention to provide a ratchet-type reversible wrench which avoids the disadvantages of the prior art in that direction of rotation of inner part of this wrench can be switched by a switch which is on the end of the handle of the wrench or said direction of rotation can be switched even by rotation of handle of the wrench itself.

Another object is to provide a wrench of this character with such mechanism transferring effort from the wrench handle to an inner part of the wrench contacting with socket which would turn on and turn off by a force acting to the handle of the wrench but not because of rotating of a wrench head as it is in prior art.

It is another object to place a drive of turning mechanism in the reversible wrench handle, but not in a head of wrench as it is in prior art.

Another object is to provide a wrench of this character with two different sizes square drive studs to make a wrench twice more universal.

A further object is to provide a wrench of this character with such ratchet mechanism that having a minimum size passes the maximum effort from the handle to the inner member and further to a socket.

It is another object to reduce friction in ratchet mechanism itself during back stroke that is very important in the beginning of screwing and in the ending of unscrewing of bolts and screws.

The novel features which are considered characteristic for the present invention are set forth in particular in the appended claims. The invention itself, however, will be best understood from the following description which is accompanied by the following drawings.

DESCRIPTION OF A PREFERRED EMBODIMENT

Figure 1:
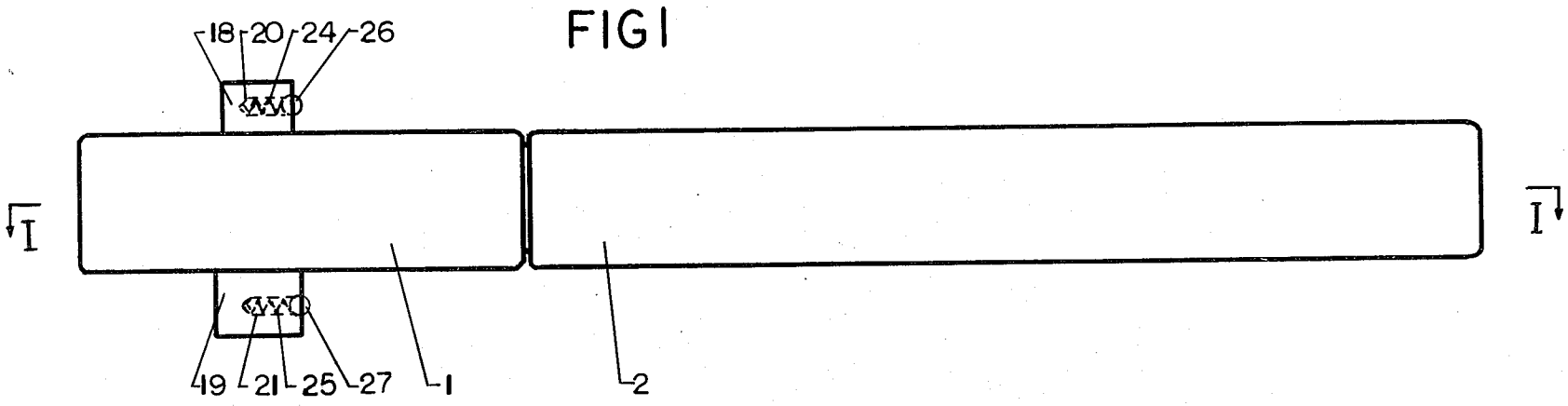
FIG. 1 is a side elevational view of the reversible ratchet wrench in accordance with the present invention.
Figure 2:
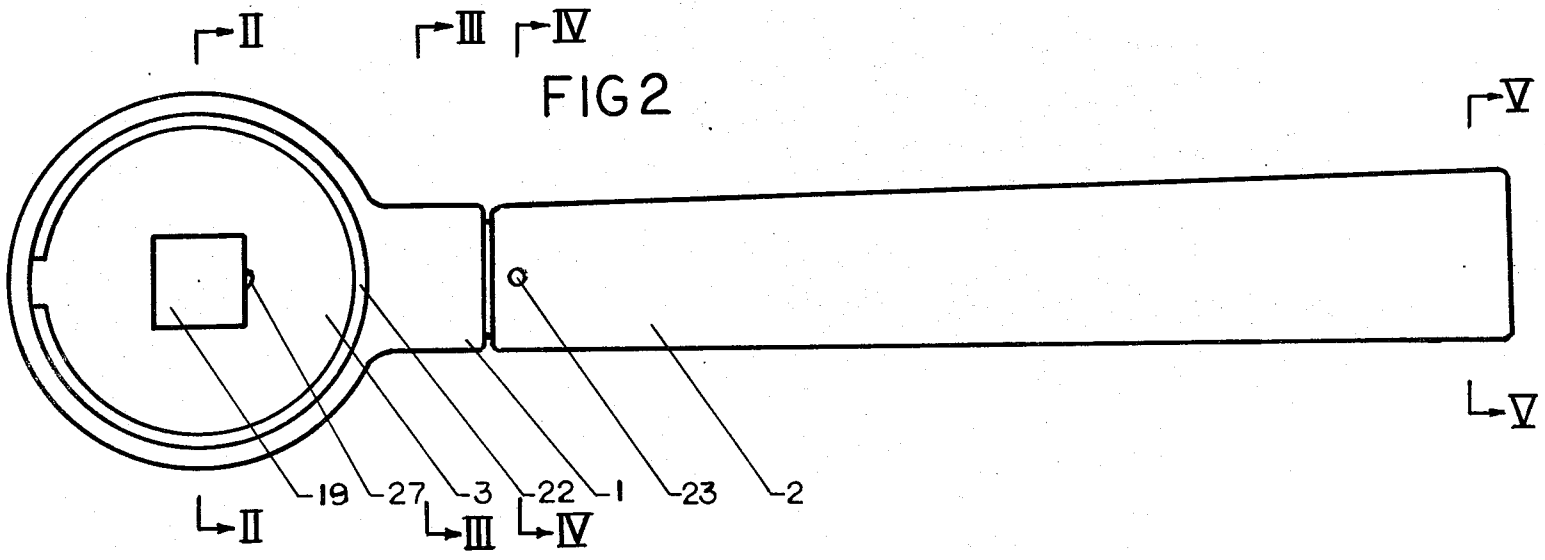
FIG. 2 is a plan elevational view of the reversible ratchet wrench corresponding to that of FIG. 1 looking at one working face.

A reversible ratchet wrench in accordance with the present invention has an outer housing member indentified by reference numeral I and a rotatable chuck 3 supplied with two studs 18 and 19 that are integral parts of said chuck 3. These two studs have cavities 20 and 21 with springs 24 and 25. In outlets of the cavities 20 and 21 there are exposed balls 26 and 27 to fix sockets on said studs. The chuck 3 also may be supplied only with one such stud 18 or 19, or may have a hexagonal, square, octahedral or other forms of inner recess, in dependence upon the shapes of nuts or bolts to be handled by the wrench.

Handle 2 connects with housing member 1 by two pivot pins 23 and this handle 2 can swing restricted on housing member 1.

Figures 3, 4, 5, 6, 7, 8:
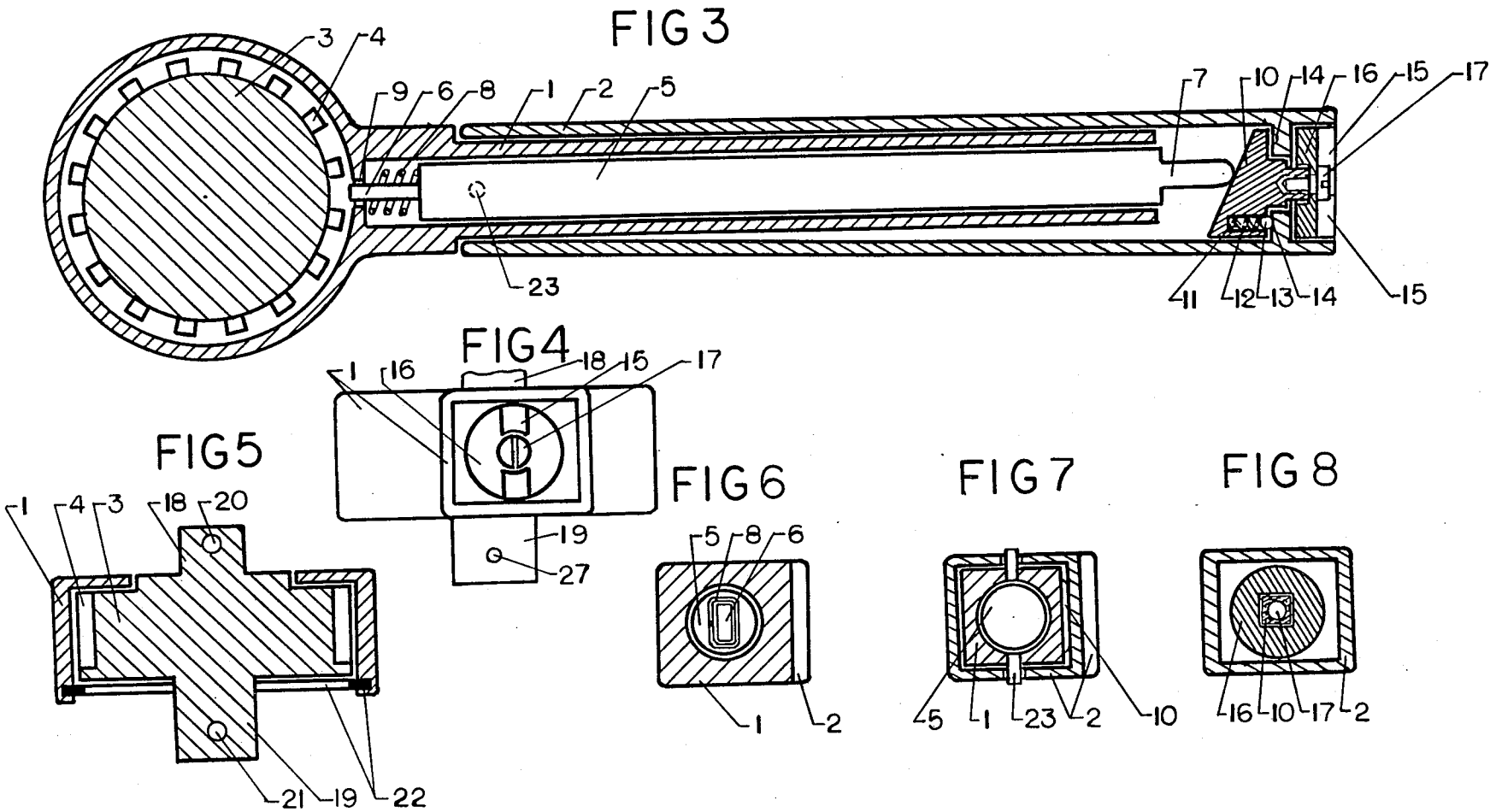
FIG. 3 is an elevational cross sectional view of the reversible ratchet wrench of FIG. 1 taken along the line I—I during an idle stroke when the switch of the wrench is in the position to turn fast a nut.
FIG. 4 is an edge elevational view of the reversible ratchet wrench corresponding to that of FIG. 1 looking at the back end of the handle.
FIG. 5 is a vertical cross sectional view through the head of the reversible ratchet wrench taken on line II—II of FIG. 2.
FIG. 6 is a vertical cross sectional view of the reversible ratchet wrench taken on line III—III of FIG. 2.
FIG. 7 is a vertical cross sectional view of the reversible ratchet wrench taken on line IV—IV of FIG. 2.
FIG. 8 is a vertical cross sectional view of the reversible ratchet wrench taken on line V—V of FIG. 2.
Figures 3A, 3B, 3C:
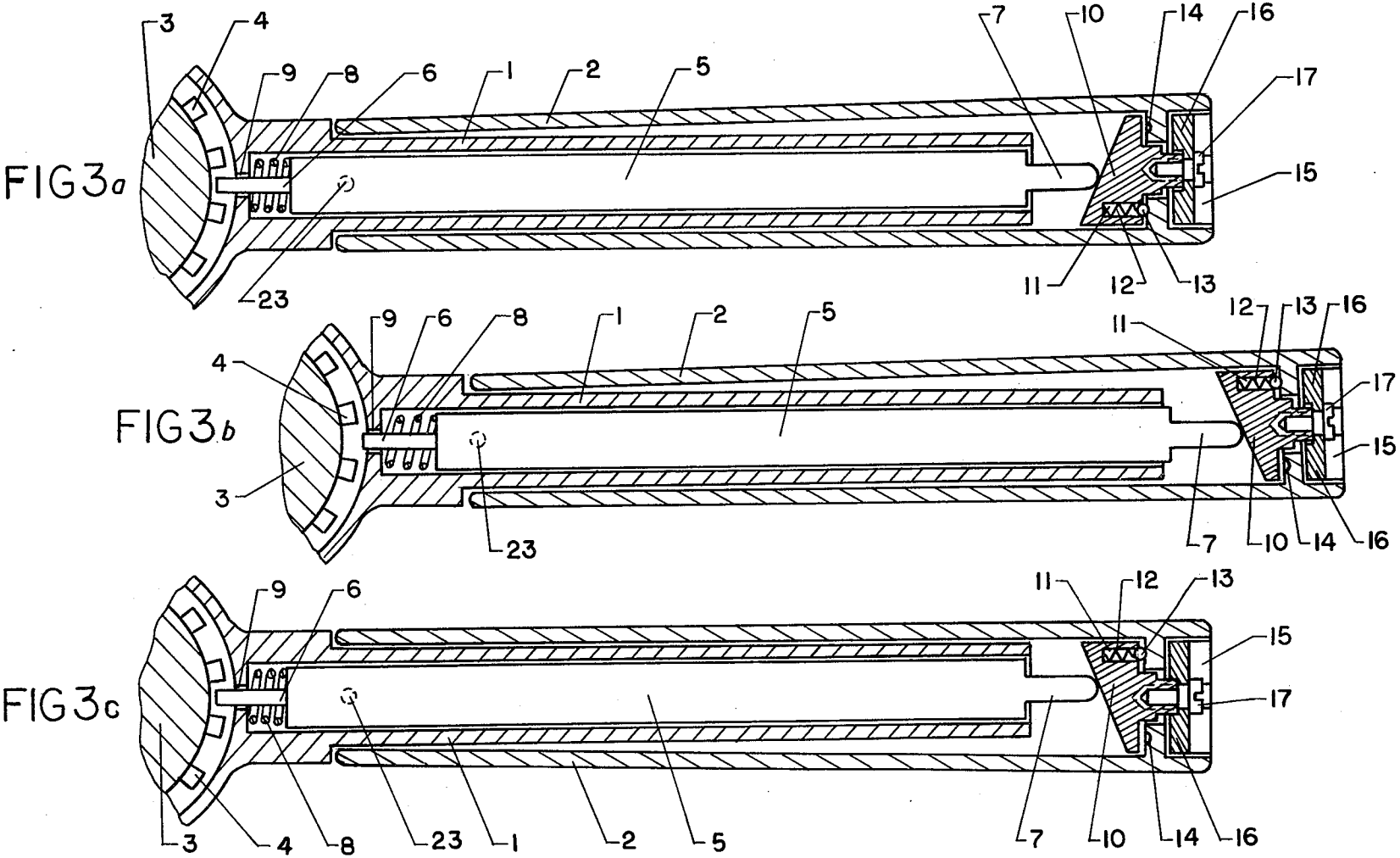
FIG. 3*a* is a fragmentary cross sectional view similar to FIG. 3 during a working stroke when the switch of the wrench is in the position to turn fast a nut.
FIG. 3*b* is a fragmentary cross sectional view similar to FIG. 3 during an idle stroke when the switch of the wrench is in the position to unscrew a nut.
FIG. 3*c* is a fragmentary cross sectional view similar to FIG. 3 during a working stroke when the switch of the wrench is in the position to unscrew a nut.

As can be seen from FIG. 5 the head of the outer housing member 1 has a circumferential wall and one lateral wall. The rotatable chuck 3 is closed in the head of housing member 1 by a locking ring 22.

A special ratchet mechanism is provided in the wrench. The ratchet mechanism includes one tooth 6 which is provided on rod 5 (the rod 5 is so called effort transferring element) which has a shoulder 7 on its opposite side. The spring 8 covers the tooth 6 and rests against flat surfaces of the rod 5 and outer housing member 1. The tooth 6 may pass through aperture 9 in outer housing member 1 to engage with another part of the ratchet mechanism which is a plurality of engaging projections 4 on the outer surface of the chuck 3.

In the end part of the handle 2 is located a switch of direction of rotation which consists of a knob 16 with projections 15 and another detail 10 (it is so called effort direction changing element) joined between themselves by a screw 17. The detail 10 has one skewed surface and a cavity 11 with spring 12 and a fixing ball 13 that fixes the detail 10 in determined position entering into one of two cavities 14 in the handle 2.

In FIG. 3 the reversible ratchet wrench is in neutral position. Now if the handle 2 is turned counter clockwise and upwards then at first this handle 2 pivots round the pins 23 and the skewed surface of the detail 10 presses the shoulder 7 of the rod 5 and moves this rod towards the chuck 3 overcoming the resistance of the spring 8 and engaging the tooth 6 with one of the projections 4 of the chuck 3. The chuck 3 begins to rotate counter-clockwise turning fast a screw or a bolt. This is a working stroke. After this working stroke there is an idling stroke. The handle 2 is turned clockwise and downwards and the skewed surface of the detail 10 stops to press the shoulder 7 of the rod 5 and the spring 8 moves the rod 5 from the chuck 3 disengaging the tooth 6 from the projection 4. The chuck 3 stays in its former position and the housing member 1 with handle 2 are being turned to the initial position. If the handle 2 is turned counter-clockwise and upwards again then the cycle will be repeated.

If it is necessary to unscrew a bolt or a screw then the detail 10 has to be turned 180° by the switch 16. Now if the handle 2 is turned counter-clockwise and upwards then the idle stroke will occur but when the handle 2 is turned clockwise and downwards—there is a working stroke and everything is understood from previous explanation.

The reversible ratchet wrench may be produced such that a skewed surface that has to press the shoulder 7 of the rod 5 is integral with said handle. Then switching of direction of rotation of the wrench will be fulfiled by turning said handle 180° around its axis. Of course the configuration and some details of the wrench will be changed a little without departing from the fundamental concept of the invention.

The described and drawed wrench is the so called wrench of straight action when in neutral position the spring 8 withdraws the tooth 6 from the projections 4 and only turning the handle 2 to the determined direction overcomes the force of the spring 8 and engages the tooth 6 with the projections 4 and thus turns the chuck 3. This is the working stroke. Reversible turning of the handle 2 does not influence the spring 8 and the tooth 6 does not engage with projections and the chuck 3 remains immovable. This is an idle stroke.

But the reversible wrench based on the concept of this invention may be so called reverse acting when in neutral position a spring presses a tooth being in a handle towards projections of a chuck being inside of a head of a wrench and in neutral position said tooth engages said projections. Turning of the handle to the determined direction does not influence the spring and said tooth and thus the chuck is turned by handle. This is the working stroke. Reversible turning of the handle overcomes the force of the spring inside the handle and disjoins the tooth located in the handle of the wrench with the projections of the chuck located inside the head of the wrench. The chuck remains immovable. This is the idle stroke. In the reverse acting wrench a detail corresponding to the rod 5 of the wrench of straight acting may be flexible.

It is to be understood that the invention is not limited to the details shown inasmuch as any modifications and structural changes are possible without departing in any way from the spirit of the present invention.

What is claimed is:

1. A ratchet-type reversible wrench comprising:

a handle conforming to the hand of the operator and which is grasped by the operator's hand;

an outer housing member surrounding an inner member and rotatable relative to the latter;

said inner member supplied with means connecting with a nut to turn the latter;

means for rotating said inner member relative to said outer housing member;

said rotating means including a plurality of engaging teeth provided on said inner member and at least one engaging formation located in said outer housing member, so that when said outer housing member is rotated relative to said inner member in one circumferential direction said inner member and thereby a nut connected to the latter are rotated, whereas when said outer housing member is rotated in another circumferential direction said inner member and thereby the nut connected to the latter do not rotate;

switching means located on said handle to reverse direction of rotation of said inner member;

special effort transmissive means including an effort transferring element which transfers effort from said handle to said engaging formation located in said outer housing member to engage and disengage said formation with said plurality of engaging teeth provided on said inner member depending on direction of turning of said handle;

the handle characterized in that:

a. said handle is pivotally mounted on said outer housing member thus that said handle performs a limited transverse counter motion relatively to said outer housing member during working cycle;

b. on said handle is located said switching means, said switching means including at least two elements one of which is a switching knob located on said handle and the second one is an effort direction changing cam which is located inside of the handle and which acts upon said effort transferring element which in its turn influences on said engaging formation located in said outer housing member to engage and disengage said formation with said plurality of engaging teeth provided on said inner member depending on direction of turning of said handle.

2. A ratchet-type reversible wrench as claimed in claim 1 in which said effort direction changing cam has skewed surface contacting and pressing said effort transferring element.

3. A ratchet-type reversible wrench as claimed in claim 1 in which said engaging formation located in the outer housing member is an integral part of said effort transferring element.

4. A ratchet-type reversible wrench as claimed in claim 1 in which said switching means are located in the back end of the handle.

5. A ratchet-type reversible wrench as claimed in claim 4 in which said switching means have fixing means to lock said switching means in one of two working positions.

6. A ratchet-type reversible wrench as claimed in claim 1 in which said means connecting with a nut to turn the latter consist of at least one square stud projecting outside of said inner member to connect with sockets.

7. A ratchet-type reversible wrench as claimed in claim 1 in which said means connecting with a nut to turn the latter is a nut receiving recess with an axis and a shape corresponding to that of a nut.

* * * * *